US006160980A

United States Patent [19]

Ziegelmuller et al.

[11] Patent Number: 6,160,980

[45] Date of Patent: Dec. 12, 2000

[54] METHOD AND APPARATUS FOR REDUCING CONTAMINATION OF A TACKDOWN, CAPTURE OR TRANSFER ROLLER ON A SPLICED PHOTOCONDUCTOR OR TRANSPORT WEB

[76] Inventors: Francisco Luiz Ziegelmuller; Maria Bernadette Carrone, both of NexPress Solutions, LLC 1447 St. Paul St., Rochester, N.Y. 14653-7001

[21] Appl. No.: 09/437,552

[22] Filed: Nov. 10, 1999

[51] Int. Cl.[7] ..... G03G 15/14; G03G 21/00

[52] U.S. Cl. ..... 399/303; 399/312

[58] Field of Search ..... 399/297, 303, 399/312, 313, 160, 162

[56] References Cited

U.S. PATENT DOCUMENTS

| | | | |
|---|---|---|---|
| 5,101,232 | 3/1992 | Evans et al. | 399/160 |
| 5,315,355 | 5/1994 | Johnson | 399/303 |
| 5,600,421 | 2/1997 | Takekoshi et al. | 399/303 X |
| 5,819,140 | 10/1998 | Iseki et al. | 399/303 X |
| 5,845,188 | 12/1998 | Fujii et al. | 399/303 X |
| 6,002,902 | 12/1999 | Thornton et al. | 399/162 |
| 6,016,415 | 1/2000 | Herrick et al. | 399/303 X |

*Primary Examiner*—Fred L. Braun
*Attorney, Agent, or Firm*—Lawrence P. Kessler

[57] ABSTRACT

In a method and apparatus for transferring a toner image to a receiver sheet, there is provided an endless belt that is mounted for movement in a direction along a lengthwise dimension of the belt and through an endless path. The belt includes a splice seam that occurs transverse to the direction of movement of the belt, the seam having a discontinuity into which toner tends to collect which is free to transfer. The seam includes a bump proximate each end of the splice seam which extends above the seam. A rotatable member rotates while in engagement with a surface of the belt so as to urge a receiving sheet into intimate engagement with the surface between the rotatable member and the belt. The bumps support the rotatable member out of engagement with the splice seam to substantially preclude transfer to the rotatable member of toner accumulating in the splice seam between the bumps.

29 Claims, 7 Drawing Sheets

OTHER POSSIBLE BUMP CONFIGURATION

METHOD AND APPARATUS FOR REDUCING CONTAMINATION OF A TACKDOWN, CAPTURE OR TRANSFER ROLLER ON A SPLICED PHOTOCONDUCTOR OR TRANSPORT WEB

FIELD OF THE INVENTION

This invention relates to transfer of toner images and more specifically to a belt for use in transfer of such images and a method and apparatus for use of such belt for maintaining intimate contact between a receiving sheet and a toner image to be placed on the receiving sheet.

BACKGROUND OF THE INVENTION

In electrostatographic image forming apparatus, toner images are formed on the surface of a toner image bearing member (TIBM) and then transferred to a receiving sheet. One known approach to transferring a toner image to a receiving sheet is to place the receiving sheet between the image member and a transfer member, for example, a transfer roller. The transfer roller is biased to create an electric field urging the toner toward the sheet and also helps maintain intimate contact between the sheet and the toner image.

Transfer rollers thus have been used in electrostatographic copiers and printers to move toner particles on the photoconductor web to sheets of paper, transparencies or other medium. This is done by charging the medium with opposite polarity charges to that of toner.

Tackdown rollers are used in color electrostatographic copiers or printers to electrostatically tack down the sheets of paper or other medium to a transport web. The tack down function is accomplished by charging up the paper with opposite charges to that of the web. These rollers serve as a charger and they also "iron" out air pockets between the paper and the transport web.

Alternatively, the tackdown roller function can be accomplished by an uncharged capture roller which will iron down the paper to the web removing air pockets and ensuring the delivery of the sheets to a corona charger which then tacks down the sheets to a transport web. The transport web moves the sheets of paper through the separate color engines.

In the above applications, the photoconductor web or transport web will have a splice seam where toner particles can collect due to the physical discontinuities in the surface at the seam. Cleaning methods for these webs are not effective in completely removing all the toner from the splice. As the splice seam passes by the above rollers, some toner particles are transferred to the roller surface. The scam contamination then transfers to the sheets passing by the rollers generating line artifacts.

In color applications with a transport web, toner collected from the splice seam can be redeposited onto the web surface and to the imaging side of the incoming sheets passing by the roller. In the transfer roller applications, the artifact shows up on backsides of copies. Toner splice artifacts can occur multiple times within a sheet of paper.

The transfer of toner particles from the splice to the roller can occur in either metallic rollers or in compliant rollers with urethane blankets. Methods such as reverse biasing to prevent toner pick up are not always effective to completely eliminate the artifacts and they are generally expensive to implement. Other attempts to smooth the web splice do not completely eliminate toner collected there. A combination of reverse bias with an active cleaner and coatings on the roller to reduce the roller surface energy can be used which increases the cost and drag torque on the roller.

The presence of a splice seam on the web may need to be monitored to avoid imaging over it since artifacts can be produced on both sides of the sheets. An improvement in this regard is disclosed in U.S. application Ser. No. 09/199,896, filed Nov. 25, 1998, now U.S. Pat. No. 6,016,415.

In applications where the roller has a compliant blanket such as urethanes and when there might be high pressure contact, a compression set can be impressed on the roller when parked for extended periods of time against a hard backup roller. In these applications, it is desirable to articulate the roller away from the hard back up roller to avoid the formation of a compression set. The articulation means are costly and it occupies premium space in the overall design of the copiers.

A simple solution to the above problems that will prevent the transfer of toner particles from a seam formed by the splice to a transfer, tackdown or capture roller and thus avoid or reduce the generation of artifacts on copies would be highly desirable.

SUMMARY OF THE INVENTION

In accordance with a first aspect of the invention, there is provided an image-forming apparatus for transferring a toner image to a receiver sheet, the apparatus comprising an endless belt mounted for movement in a direction along a lengthwise direction of the belt and through an endless path, the belt including a splice seam that occurs in a direction transverse to the direction of movement of the belt and forming a discontinuity into which toner may tend to accumulate; a rotatable member positioned to urge a receiving sheet into intimate contact with the belt; and a bump proximate each end of the splice seam and extending over the seam to support the rotatable member out of engagement with the splice seam to substantially preclude transfer to the rotatable member of toner accumulating in the splice seam in the space between the bumps as the rotatable member moves over the seam.

In accordance with a second aspect of the invention, there is provided in a method for transferring a toner image to a receiver sheet, the method comprising moving an endless belt mounted for movement in a direction along a lengthwise dimension of the belt and through an endless path, the belt including a splice seam that occurs transverse to the direction of movement of the belt the seam having a discontinuity into which toner tends to collect which is free to transfer and the seam including a bump proximate each end of the splice seam and extending above the seam; and rotating a rotatable member while in engagement with a surface of the belt so as to urge a receiving sheet into intimate engagement with the surface between the rotatable member and the belt; and the bumps supporting the rotatable member out of engagement with the splice scam to substantially preclude transfer to the rotatable member of toner accumulating in the splice seam between the bumps.

BRIEF DESCRIPTION OF THE DRAWINGS

In the detailed description of the preferred embodiments of the invention presented below, reference is made to the accompanying drawings, in each of which the relative relationship of the various components are illustrated, it being understood that orientation of the apparatus may be modified.

DETAILED DESCRIPTION OF THE PREFERRED EMBODIMENTS

Because apparatus of the general type described herein arc well known, the present description will be directed in particular to elements forming part of, or cooperating more directly with, the present invention. While the invention will be described with reference to an electrophotographic system, the invention can also be used in an electrographic system too.

The invention will first be described in use with various types of known apparatus such as exemplified in U.S. patent application Ser. No. 09/199,896, filed on Nov. 25, 1998, now U.S. Pat. No. 6,016,415 and then a more detailed description of the invention will be provided.

Figure 1:
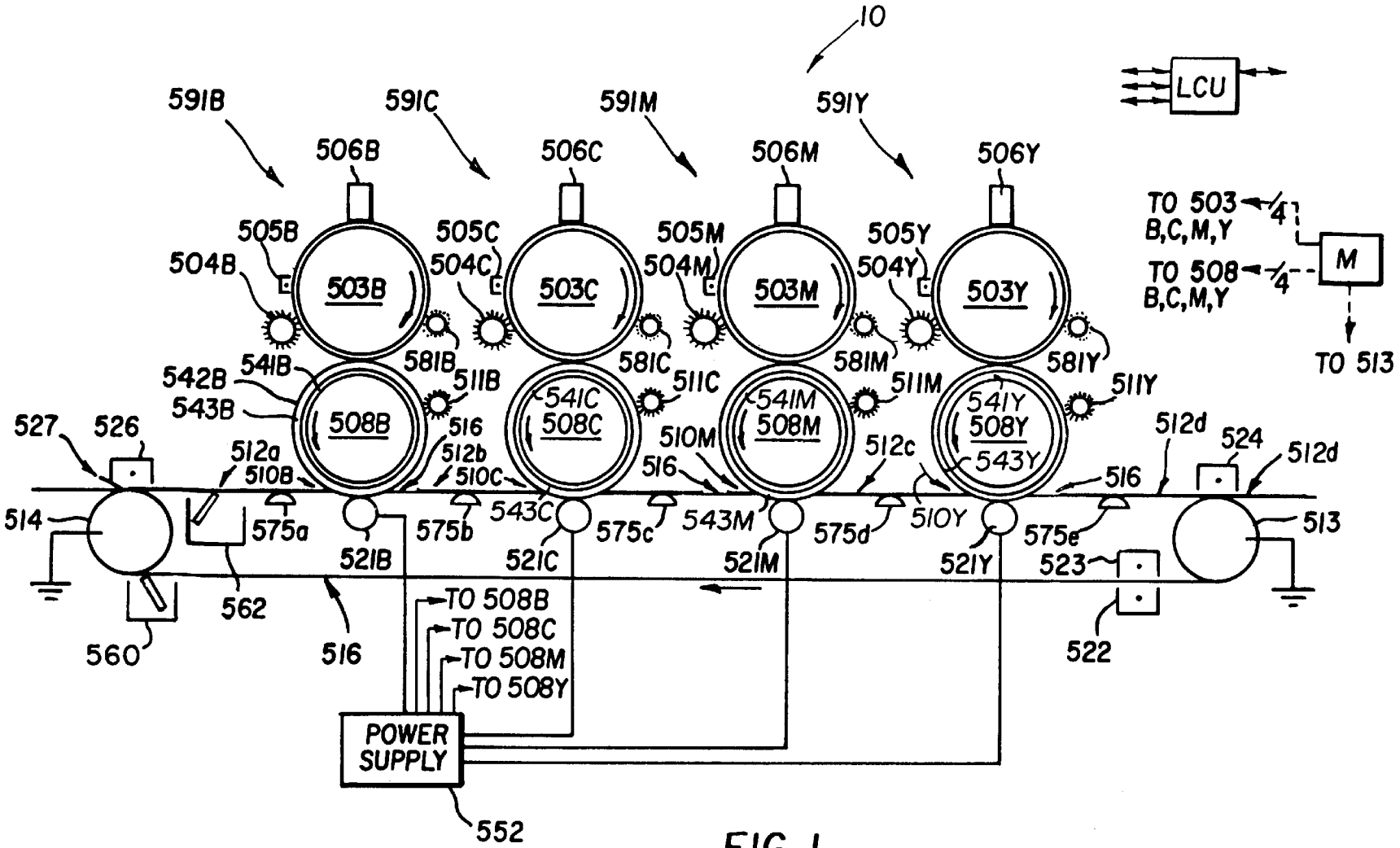
FIG. 1 is a generally schematic side elevational view of a preferred first embodiment of a reproduction apparatus according to the invention.

Referring now to the accompanying drawings, FIG. 1 shows an exemplary image forming reproduction apparatus designated generally by the numeral 10. The reproduction apparatus 10 is in the form of an electrophotographic reproduction apparatus and more particularly a color reproduction apparatus wherein color separation images are formed in each of four colors and transferred in register to a receiver member as a receiver member is moved through the apparatus while supported on a paper transport web 516 that is made in accordance with the invention. The apparatus features four color modules. However, the invention in each case to be described may be used in apparatus having one or more such modules.

Each module (591B, 591C, 591M, 591Y) is of similar construction except that as shown one paper transport belt 516 operates with all the modules and the receiver member is transported by the belt 516 from module to module. The elements in FIG. 1 that are similar from module to module have similar reference numerals with a suffix of B, C, M and Y referring to the color module to which it is associated. Three receiver members or sheets 512*a, b*, and *c* are shown simultaneously receiving images from different respective color modules, it being understood as noted above that each receiver member may receive one color image from each module and that up to four color images can be received by each receiver member. A fourth receiver member 512*d* is shown in a position after being processed through the last color module 591Y. The movement of the receiver member with the belt 516 is such that each color image transferred to the receiver member at the transfer nip of each module is a transfer that is registered with the previous color transfer so that a four-color image formed on the receiver member has the colors in registered superposed relationship on the receiver member. The receiver members are then sent to a fusing station (not shown) to fuse or fix the dry toner images to the receiving member. The belt is reconditioned by providing charge to both surfaces using, for example, opposed corona chargers, transport web conditioning chargers, 522, 523 which neutralize charge on the surfaces of the belt.

Each color module includes a primary image forming member (PIFM), for example a drum 503B, C, M and Y, respectively. Each drum 503B, C, M and Y has a photoconductive surface, upon which a pigmented marking particle image, or a series of different color marking particle images, is formed. In order to form images, the outer surface of the drum is uniformly charged by a primary charger such as a corona charging device 505 B, C, M and Y, respectively or other suitable charger such as roller chargers, brush chargers, etc. The uniformly charged surface is exposed by suitable exposure means, such as for example a laser 506 B, C, M and Y, respectively or more preferably an LED or other electro-optical exposure device or even an optical exposure device to selectively alter the charge on the surface of the drum to create an electrostatic image corresponding to an image to be reproduced. The electrostatic image is developed by application of pigmented marking particles to the latent image bearing photoconductive drum by a development station 581 B, C, M and Y, respectively. The development station is a particular color of pigmented toner marking particles associated respectively therewith. Thus, module creates a series of different color marking particle images on the respective photoconductive drum. In lieu of a photoconductive drum which is preferred, a photoconductive belt may be used.

Each marking particle image is transferred to an outer surface of a respective secondary or intermediate transfer member (ITM), for example, an intermediate transfer drum 508 B, C, M and Y, respectively. After transfer the toner image is cleaned from the surface of the photoconductive drum by a suitable cleaning device 504 B, C, M and Y, respectively to prepare the surface for reuse for forming subsequent toner images. The intermediate transfer drum or member (ITM) includes a metallic (such as aluminum) conductive core 541 B, C, M and Y, respectively and a compliant blanket layer 543 B, C, M and Y, respectively. The compliant layer is formed of an elastomer such as polyurethane or other materials well noted in the published literature. The elastomer has been doped with sufficient conductive material (such as antistatic particles, ionic conducting materials, or electrically conducting dopants) to have a relatively low resistivity (for example, a bulk or volume electrical resistivity preferably in the range of approximately $10^7$ to $10^{11}$ ohm-cm). Further, the compliant blanket layer is more than 1 mm thick, preferably between 2 mm and 15 mm, and has a Young's Modulus in the range of approximately 0.1 MPa to 10 MPa, and more preferably between 1 MPa and 5 MPa. The blanket layer has a bulk or volume electrical resistivity that is preferably between $10^7$ to $10^{11}$ ohm-cm. A thin (2 $\mu$m to 30 $\mu$m) hard overcoat layer covers the blanket layer and the overcoat layer has a Young's modulus of preferably greater than 100 MPa. The hard overcoat layer may have a higher bulk or volume electrical resistivity than the blanket layer. With such a relatively conductive intermediate image transfer member drum, transfer of the single color marking particle images to the surface of the ITM can be accomplished with a relatively narrow nip and a relatively modest potential of, for example, 600 volts of suitable polarity applied by a potential source (not shown).

A single color marking particle image respectively formed on the surface 542B (others not identified) of each intermediate image transfer member or drum, is transferred to a receiver member, which is fed into a nip between the intermediate image transfer member drum and a transfer backing roller 521B, C, M and Y, respectively that is suitably electrically biased by power supply 552 to induce the charged toner particle image to transfer to a receiver sheet or member. The receiver member is fed from a suitable receiver member supply (not shown) and moves serially into each of the nips 510B, C, M and Y where it receives a respective marking particle image. The receiver member exits the last nip and is transported by a suitable transport mechanism (not shown) to a fuser where the marking particle image is fixed to the receiver member by application of heat and/or pressure and, preferably, without application of heat. A detack charger 524 may be provided to deposit a neutralizing charge on the receiver member to facilitate separation of the receiver member from the belt 516. The receiver member with the fixed marking particle image is then transported to a remote location for operator retrieval. The ITM is cleaned by a cleaning device 511B, C, M and Y to prepare it for reuse. Although the ITM is preferred to be a drum, a belt may be used instead as an ITM.

Appropriate sensors (not shown) of any well known type, such as mechanical, electrical, or optical sensors for example, are utilized in the reproduction apparatus 10 to provide control signals for the apparatus. Such sensors are located along the receiver member travel path between the receiver member supply through the various nips to the fuser. Further sensors may be associated with the primary image forming member photoconductive drum, the intermediate image transfer member drum, the transfer backing member, and various image processing stations. As such, the sensors detect the location of a receiver member in its travel path, and the position of the primary image forming member photoconductive drum in relation to the image forming processing stations, and respectively produce appropriate signals indicative thereof. Such signals are fed as input information to a logic and control unit LCU including a microprocessor, for example. Based on such signals and a suitable program for the microprocessor, the unit LCU produces signals to control the timing operation of the various electrographic process stations for carrying out the reproduction process and to control drive by motor M of the various drums and belts. The production of a program for a number of commercially available microprocessors, which are suitable for use with the invention, is a conventional skill well understood in the art. The particular details of any such program would, of course, depend on the architecture of the designated microprocessor.

The receiver members utilized with the reproduction apparatus 10 can vary substantially. For example, they can be thin or thick paper stock or transparency stock. As the thickness and/or resistivity of the receiver member stock varies, the resulting change in impedance affects the electric field used in the nips 510B, C, M, Y to urge transfer of the marking particles to the receiver members. Moreover, variations in relative humidity will vary the conductivity of a paper receiver member, which also causes it to affect the impedance of the transfer field. To overcome these problems, the paper transport belt preferably includes certain characteristics.

The endless paper transport belt 516 is entrained about a plurality of support members. For example, as shown in FIG. 1, the plurality of support members are rollers 513, 514 with preferably 513 being driven as shown by motor M (of course, other support members such as skis or bars would be suitable for use with this invention). The endless belt or web 516 is preferably comprised of a material having a bulk electrical resistivity greater than $10^5$ ohm-cm and where electrostatic hold down of the receiver member is not employed, it is more preferred to have a bulk electrical resistivity of between $10^8$ ohm-cm and $10^{11}$ ohm-cm. Where electrostatic hold down of the receiver member is employed, it is more preferred to have the endless web or belt have a bulk resistivity of greater than $1\times10^{12}$ ohm-cm. This bulk resistivity is the resistivity of at least one layer if the belt is a multilayer article. The web material may be of any of a variety of flexible materials such as a fluorinated copolymer (such as polyvinylidene fluoride), polycarbonate, polyurethane, polyethylene terephthalate, polyimides (such as Kapton™), polyethylene napthoate, or silicone rubber. Whichever material that is used, such web material may contain an additive, such as an anti-stat (e.g. metal salts) or small conductive particles (e.g. carbon), to impart the desired resistivity for the web. When materials with high resistivity are used (i.e., greater than about $10^{11}$ ohm-cm), additional corona charger(s) may be needed to discharge any residual charge remaining on the web once the receiver member has been removed. The belt may have an additional conducting layer beneath the resistive layer which is electrically biased to urge marking particle image transfer, however, it is more preferable to have an arrangement without the conducting layer and instead apply the transfer bias through either one or more of the support rollers or with a corona charger. The endless belt is relatively thin (20 $\mu$m–1000 $\mu$m, preferably, 50 $\mu$m–200 $\mu$m) and is flexible.

In feeding a receiver member onto belt 516 charge may be provided on the receiver member by charger 526 to electrostatically attract the receiver member to the belt 516. Alternatively, as will be described in more detail below, the charger may be replaced by a tackdown roller or used in conjunction with a capture roller. A blade 527 associated with the charger 526 may be provided to press the receiver member onto the belt and remove any air entrained between the receiver member and the belt. The belt includes a seam as will be described in greater detail below.

A receiver member may be engaged at times in more than one image transfer nip and preferably is not in the fuser nip and an image transfer nip simultaneously. The path of the receiver member for serially receiving in transfer the various different color images is generally straight facilitating use with receiver members of different thicknesses. Support structures 575*a, b, c, d* and *e* are provided before entrance and after exit locations of each transfer nip to engage the belt on the backside and alter the straight line path of the belt to provide for wrap of the belt about each respective ITM so that there is wrap of the belt of greater than 1 mm on each side of the nip or at least one side of the nip and preferably the total wrap is less than 20 mm. This wrap allows for reduced pre-nip and post-nip ionization. The nip is where the pressure roller contacts the backside of the belt or where no pressure roller is used, where the electrical field is substantially applied. However, the image transfer region of the nip is a smaller region than the total wrap. The wrap of the belt about the ITM also provides a path for the lead edge of the receiver member to follow the curvature of the ITM but separate from engagement with the ITM while moving along a line substantially tangential to the surface of the cylindrical ITM. Pressure applied by the pressure rollers 521 B, C, M and Y is upon the backside of the belt 516 and forces the surface of the compliant ITM to conform to the contour of the receiver member during transfer. Preferably, the pressure of the pressure rollers on the belt 516 is 7 pounds per square inch or more. The pressure rollers may be replaced by corona chargers, biased blades or biased brushes. Substantial pressure is provided in the transfer nip to realize the benefits of the compliant intermediate transfer member which are conformation of the toned image to the receiver member and image content on both a microscopic and macroscopic scale. The pressure may be supplied solely by the transfer biasing mechanism or additional pressure applied by another member such as a roller, shoe, blade or brush.

Figure 2:
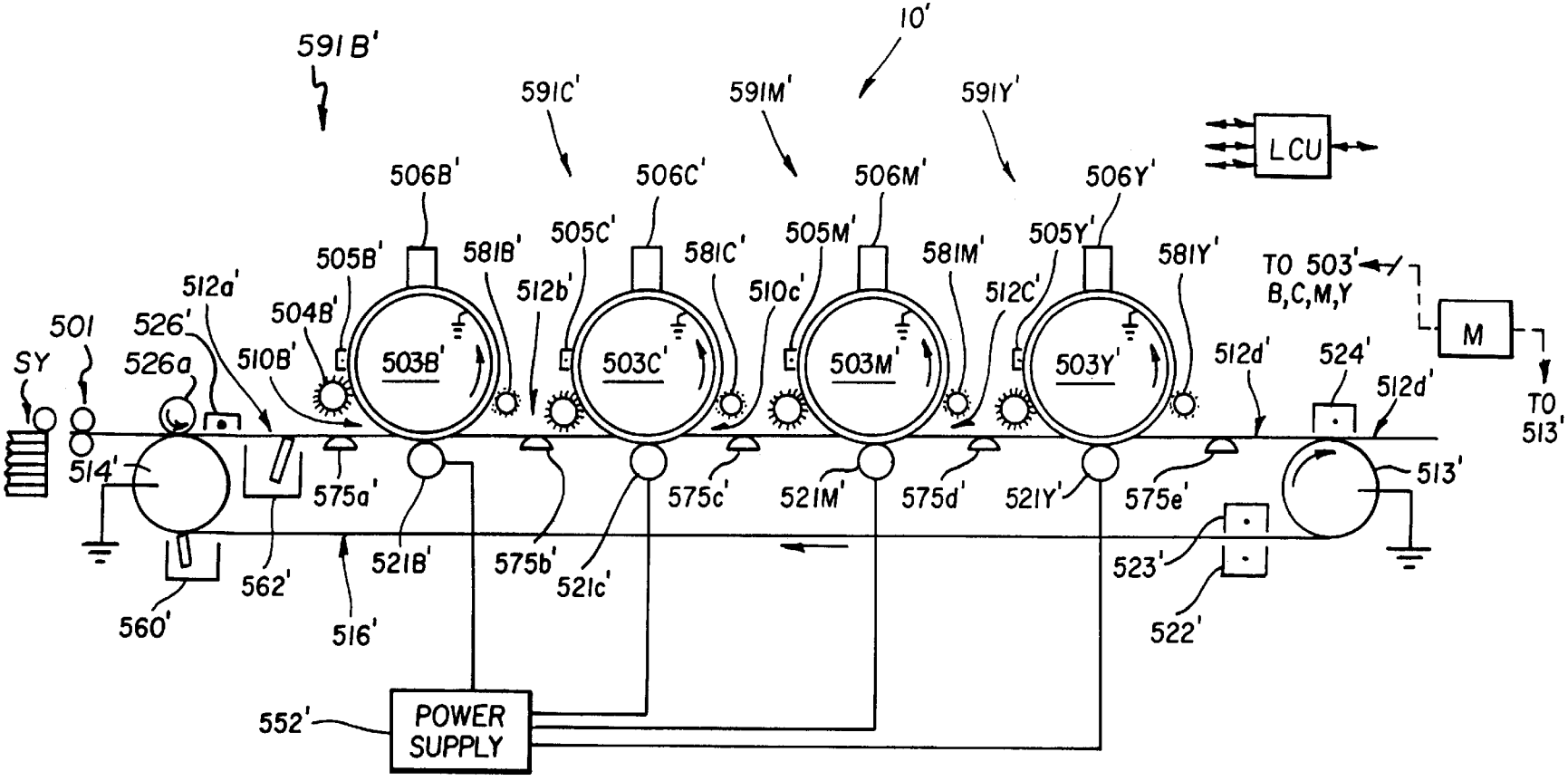
FIG. 2 is a generally schematic side elevational view of a second embodiment of a reproduction apparatus according to the invention.

With reference to FIG. 2, structures shown therein that are similar to structure in FIG. 1 are identified with a prime (') after the reference numbers. In the embodiment of FIG. 2 a toner color separation image of one of each of four colors is formed by each module 591B', 591C', 591M', and 591Y' on respective photoconductive drums 503B', 503C', 503M' and 503Y'. The respective toned color separation images are transferred in registered relationship to a receiver member as the receiver member serially travels or advances from module to module receiving in transfer at each transfer nip (510B' is the only nip designated) a respective toner color separation image. In the embodiment of FIG. 2, the ITMs are not present and direct transfer of each image is made from the photoconductive drums to the receiver sheet as the receiver sheet serially advances through the transfer stations while supported by the paper support web 516'. The web 516' is an endless belt with a seam and is similarly configured at the seam to that illustrated in FIG. 4. In both the embodiments of FIGS. 1 and 2, different receiver sheets may be located in different nips simultaneously and at times one receiver sheet may be located in two adjacent nips simultaneously, it being appreciated that the timing of image creation and respective transfers to the receiver sheet is such that proper transfer of images are made so that respective images are transferred in register and as expected. In FIG. 2, a capture roller 526*a* is used with a corona charger 526' to "iron" the receiver sheet to the transport web 516' and then to impart a charge to the receiver sheet to maintain a tacked condition of the receiver sheet to the web 516'. Each receiver sheet is fed in turn onto the transport web from a supply SY of receiver sheets through a pair of feed rollers 501 or other known types of feed. Similar arrangements for feeding sheets may be provided in the other embodiments as well.

Figure 3:
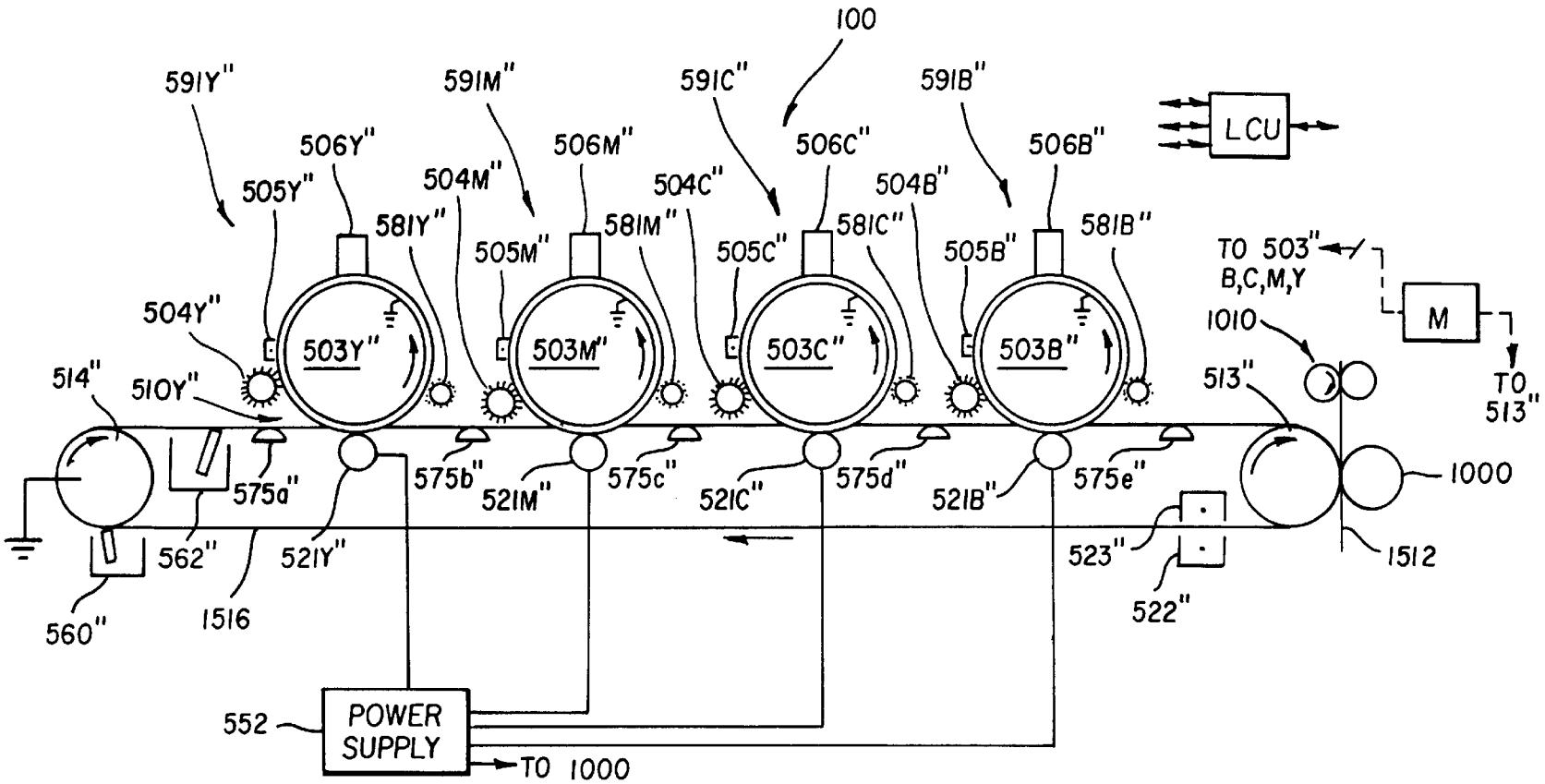
FIG. 3 is a generally schematic side elevational view of a third embodiment of a reproduction apparatus according to the invention.

With reference to FIG. 3, structures shown therein that are similar to that described with reference to FIG. 1 are identified with a double prime (") after the reference numbers. In the apparatus 100 of this embodiment the ITM is in the form of a belt 1516 and respective toner color separation images arc formed by each of the color modules 591B", 591C", 591M" and 503Y" on respective photoconductive members 503B", 503C", 503M" and 503Y" and transferred to the ITM 1516. In one embodiment ITM 1516 has the various respective color images transferred to it in registration so that for a four color image-forming process, all four images are formed on the same image frame or location on the ITM belt 1516 as a composite image and then transferred in one pass between roller 513" and transfer roller 1000 to receiver sheet or member 1512 by the receiver member being driven through the transfer nip by feed rollers 1010 and movement of the ITM belt.

Figure 5:
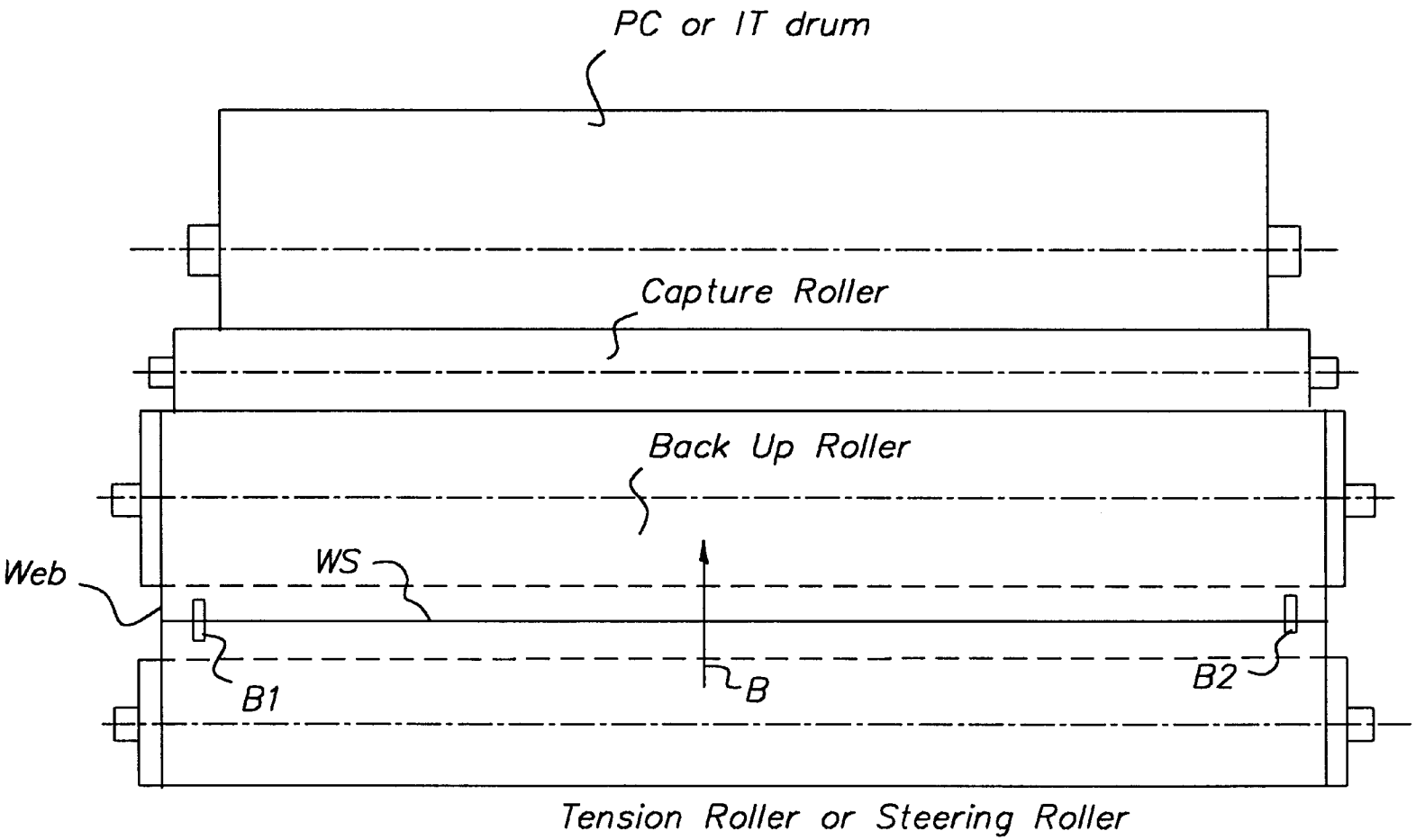
FIG. 5 is an elevational view of the portion of the apparatus illustrated in FIG. 4 and taken from a direction of view of arrow A in FIG. 4.

In a second embodiment of FIG. 3, the receiver sheet may be supported upon a transfer support drum for multiple rotation so that a series of color separation images formed on ITM 1516 in spaced relationship are transferred serially to the receiver sheet so that in four rotations of the transfer support drum a composite color toner image is first formed with proper registration on the receiver sheet. In the described embodiments of FIG. 3, the seamed portion of the ITM belt preferably has a configuration as illustrated in FIG. 5. Belts used for ITMs are well known and ITM belt 1516 may have the electrical characteristics for such known belts. In transfer of images to or from the ITM, suitable electrical biasing is provided at each transfer nip to establish an electric field to force movement of the charged toner particles to transfer to the ITM or from the ITM to the receiver member.

In the color reproduction apparatus described herein, the apparatus may also be used to form single color images or color images in various combinations of color in addition to the four-color image described. Fewer color modules may be provided in the apparatus or additional color modules may be provided in the apparatus.

In the described embodiments, the wrap of the belt that supports the receiver member in contact with the TIBM is defined by tension in the transport belt. The actual transfer nip where the major portion of the electrical field exists between the TIBM and the pressure roller or other counter electrode for transfer of the toner image to the receiver member is smaller than this wrap. Thus, by providing a greater amount of wrap length than the length of the actual transfer nip there is reduced the likelihood of pre-nip transfer and pre-nip ionization particularly where the transport belt is substantially insulative. As noted above, it is preferred to have the wrap be greater than 1mm beyond the roller nip in at least the pre-nip area. Where a pressure roller is used to apply the pressure to the underside of the belt to urge the receiver member into intimate contact with the TIBM at the nip, it is preferred that the pressure roller be of intermediate conductivity, i.e. resistivity of $10^7$–$10^{11}$ ohm-cm, however, pressure rollers that are highly conductive; i.e., having conductivity of a metal, also may be used. Other structures, as noted above, in lieu of pressure rollers may be used to apply pressure to the web at the nip including members having conductive fibers that are electrically biased and provided with stiffener structure on either side of the brush for applying pressure to the web, or rollers with conductive fibers.

In the embodiments described above, transfer of the image to the ITM and from the ITM to the receiver member and generally all image transfers are made electrostatically and preferably without addition of heat that would cause the toner to soften. Thus, preferably no fusing occurs upon transfer of the toner images to the receiver member in the nips through which the paper transport belt and receiver member passes. In the forming of plural color images in registration on a receiver sheet, the invention contemplates that plural color toner images may be formed on the same image frame of the photoconductive image member using well known techniques; see, for example Gundlach, U.S. Pat. No. 4,078,929. The primary imaging member may form images by using photoconductive elements as described or dielectric elements using electrographic recording. The toners used for development are preferably dry toners that arc preferably nonmagnetic and the development stations are known as two-component development stations. Single component developers may be used, but are not preferred. While not preferred, liquid toners may also be used.

In the color embodiments described herein, it is preferred to use dry, insulative toner particles having a mean volume weighted diameter of between about 2 $\mu$m and about 9 $\mu$m. The mean volume weighted diameter measured by conventional diameter measuring devices such as Coulter Multisizer, sold by Coulter, Inc. Mean volume weighted diameter is the sum of the mass of each particle times the diameter of a spherical particle of equal mass and density, divided by total particle mass.

With reference to FIG. 1, cleaning of the front side and back side of the belt is provided by wiper blades 560*a* and 562*a* respectively. It is preferred to use wiper blades for both of the front and backside cleaning. The blades may extend for the full width of the belt; however, it is preferred that the blades extend in general about 12 mm to about 25 mm beyond each of the edges of the widest paper size, but within the belt width and may be almost the belt width. It is preferred to have the angle of the wiper blade with the belt 516 be in the range 60° to 85°. The blade is supported as a cantilever as shown and applies a normal load from 5 to 50 g/cm. The wiper blade may be a polyurethane with a hardness within 55 to 85 shore A, a rebound resiliency above 30%, a compression set below 30%.

It is preferred that for frontside cleaning of the belt that the blade edge steps down on the belt as the splice seam passes by to minimize the impact of the splice step on the blade stability and cleaning. Since the blade on the frontside of the belt will step down while the splice seam travels past the blade, the blade on the backside of the belt will have to step up against the seam as the seam passes by.

Other types of cleaning elements may be used such as fiber brushes, magnetic brushes, pads or indexing fabric cleaners.

In still another embodiment of the invention, a web may be a photoconductive web upon which a primary image is formed. The web contains a splice seam and the features to be described below. In this regard, reference is made to U.S. Pat. No. 5,937,229, the contents of which are incorporated herein, wherein a toner image is transferred from the photoconductive web to a receiver member by moving the receiver member into a nip between the web bearing the toner image and the transfer roller to transfer the toner image to the receiver sheet. In this regard, an electrical bias is applied to the transfer roller to attract toner to the receiver sheet.

Various configurations of seams are known including those having a seam that is straight and perpendicular to the process direction and those having a seam that is at an angle other than perpendicular but is also transverse to the direction of movement of the web as it moves in the process direction. Still other seams are other than straight. All are considered within the broad term seam.

Figure 4:
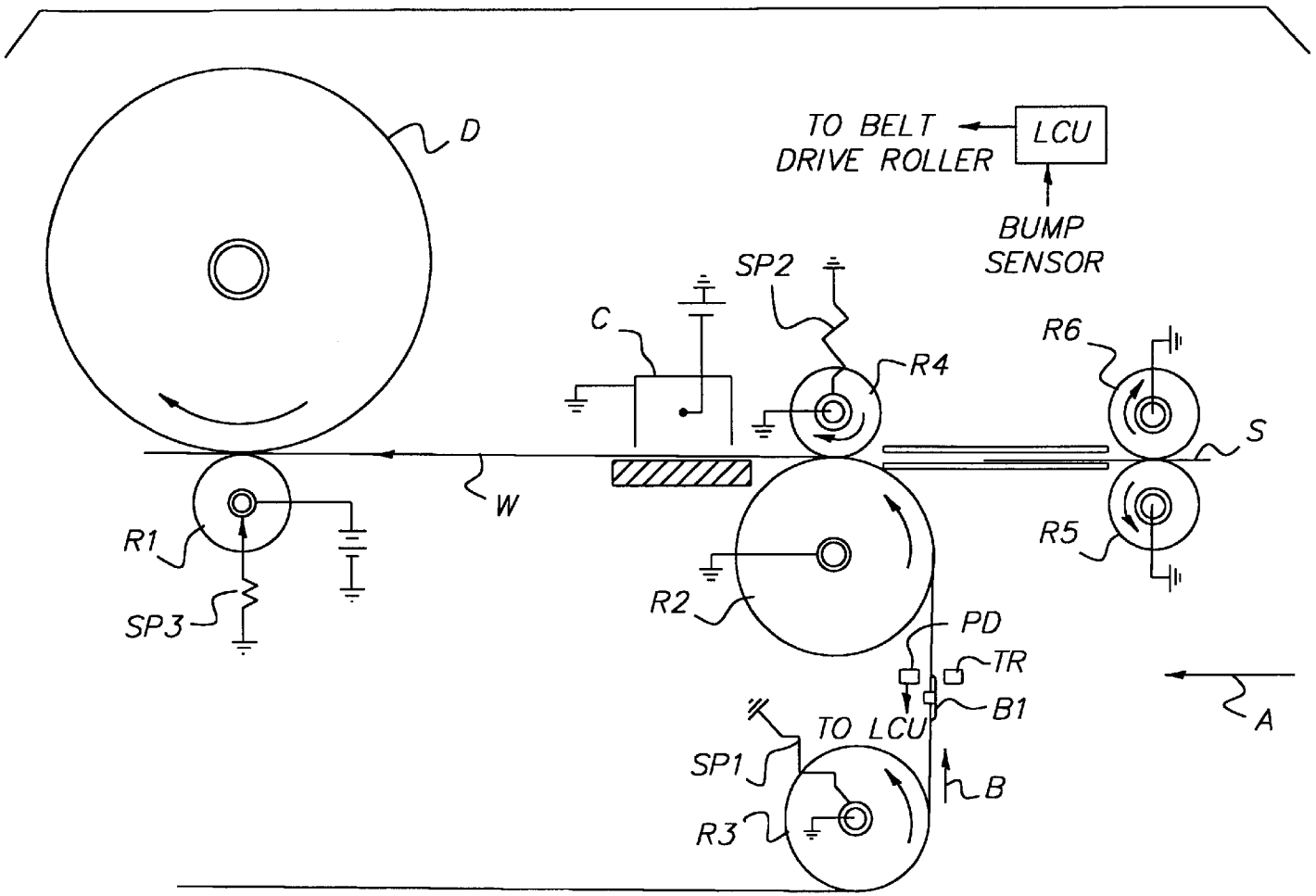
FIG. 4 is a side elevational view in schematic of a portion of an electrostatographic apparatus featuring a capture roller cooperating with a web having a splice with bumps in accordance with the invention, the splice forming a seam and the web being either a paper transport belt or an ITM belt.

With reference to FIG. 4, a belted web W is trained about first and second back-up rollers R1, R2, a tension or steering roller R3 and one or more other rollers not shown so that the web is driven in the direction of the arrow shown. To an outside surface of the web, and in engagement therewith, is a photoconductor or primary image forming drum or intermediate transfer drum D. The type of drum which D is is not important except that it is a toner image bearing member that is arranged to transfer a toner image either formed or provided thereon to, in this example, a receiver sheet S.

The receiver sheet S is driven from a supply of receiver sheets to a nip of a pair of paper feed rollers R5, R6. The sheet is guided onto the outer surface of the web in the nip formed by capture roller R4 and back up roller R2. As noted above, the capture roller "irons" or presses the sheet in intimate contact with the web surface. The tension roller and the capture roller have spring biases SP1, SP2 respectively as shown as does the back up roller R1 (spring bias SP3). The spring bias to the capture roller effects the pressing of the sheet onto the web to allow the sheet to be carried with the web. The sheet then passes beneath a corona charger C wherein corona charge of a suitable polarity is deposited on the back of the sheet to electrostatically tack the sheet to the web. The sheet then passes into the transfer nip formed between drum D and roller R1 wherein the toner image on the drum is transferred to the sheet in response to a potential difference of suitable polarity between the drum D and roller R1.

As may be seen in FIGS. 4 and 5, bumps B1, B2 are located on the web adjacent or proximate ends of the web splice seam WS. The seam provides a ridge or a step wherein toner can accumulate as is well known.

In accordance with the invention, there is provided, for each of the embodiments that employs a moving web that has a splice seam and which web engages another member such as a roller that would tend to pick up toner in the splice seam area and transfer the toner to a receiver member or sheet, a web splice that features bumps on the web splice seam. The bumps arc provided at locations on the seam to contact both ends of the roller to lift the roller away from contact with the otherwise toner contaminated splice seam. The bumps can be formed by several methods such as a thick tape strip which when strategically placed along the web and crossing the splice could be used with a photo-detector (PD) and light transmitter (TR) to sense the location of the splice and provide a signal to the logic and control unit which provides overall control of the various processes performed by the apparatus including control of drive to one of the rollers or other members used to control drive or movement of the web. This implementation would eliminate the need to generate perforations on the web to track the splice location. These perforations can be undesirable in the operation of transport web conditioning chargers (522, 523; 522', 523'). The tapes can also be used to cover the perforations to prevent arcing on the conditioning chargers.

As the location of the splice is monitored based on the bump location, machine control can be programmed to stop the movement of the web to park the roller, in this example the capture roller, on top of the bumps so that compression set of the roller would take place only in the narrow regions of the bumps. This compression set can be designed to be small enough to avoid toner transfer from the splice to the roller and to avoid roller stalling since the compression set is limited to the bump location instead of across the entire roller length. Such method also eliminates the need for an actuator to disengage the roller from the web.

Figure 6:
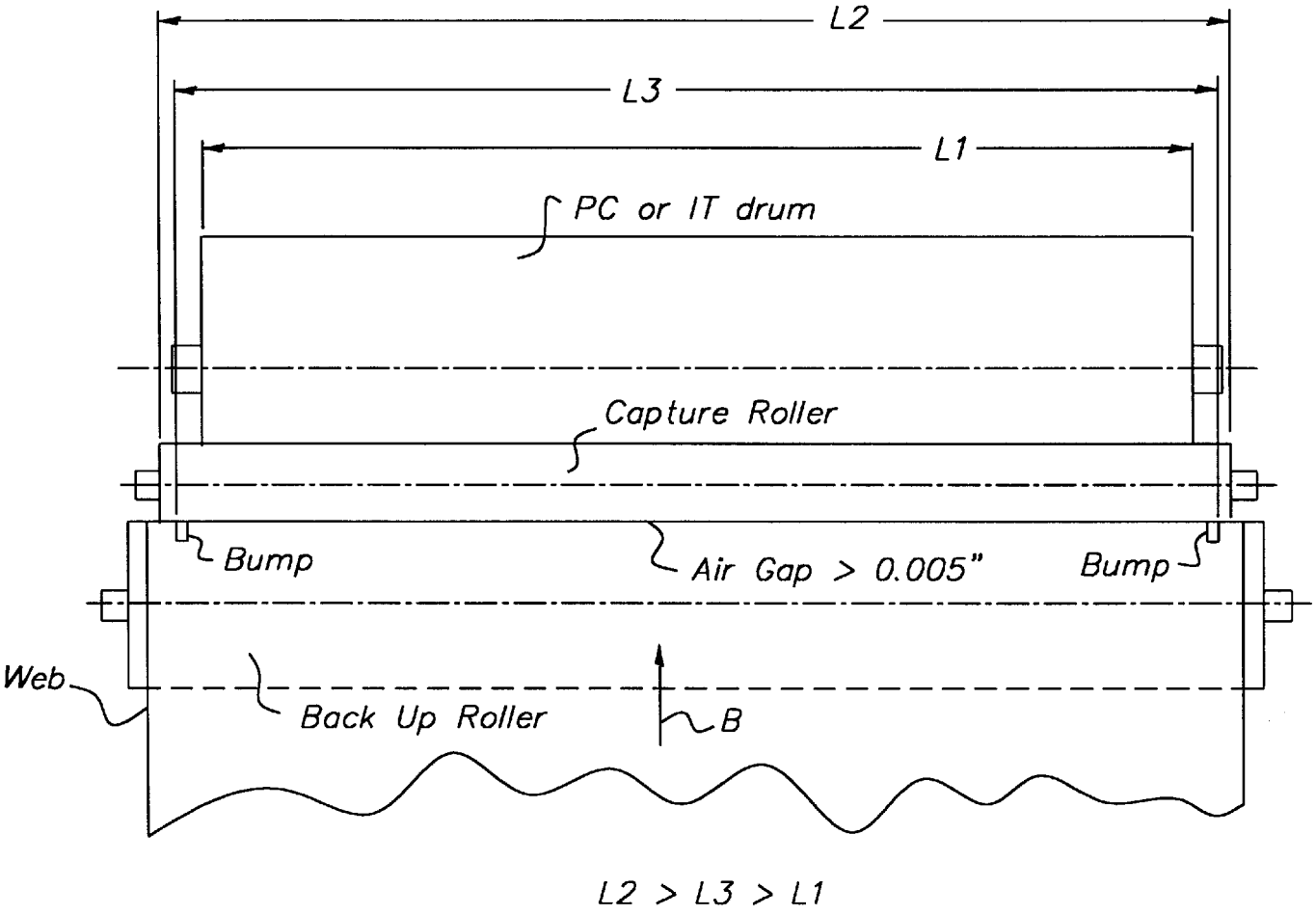
FIG. 6 is a view similar to that of FIG. 5 with certain details omitted and showing relative dimensions of various rollers relative to a location of bumps on the seam of the web in accordance with the invention.

In a preferred embodiment, the design of the roller, the web and the location of the bumps should be selected to avoid interference of the bumps with the web cleaner (blade cleaner, for instance), to avoid interference of the bumps with the photoconductor drums or intermediate transfer drums or any other critical part of the machine such as charger grid. The span between the bumps should be longer than the axial length of the PC (photoconductive drum or PIFM) or ITM (intermediate transfer member or drum) and the engagement length of the cleaning blade on the web and shorter than the tackdown or capture roller (L2>L3>L1, FIG. 6). The bumps should be located away from any imaging region.

In the selection of the bump parameters, the durometer of the compliant blanket on the roller (capture roller R4, in the example) is to be considered since with use of a softer material for the roller, the bump height needs to be higher. The hardness of a backup roller such as roller R2 that forms a nip with the roller, for example the capture roller, is preferably higher than that of the capture roller or roller to be lifted out of engagement with the seam. It is preferred that the backup roller surface which engages a surface of the web opposite the capture roller be a metal so that all deformations will occur within the more compliant capture roller. The pressure in the roller nip or the normal distributed load across the length of the capture roller will be distributed over the narrow bump strip as the roller passes by these strips causing high deformation and consequently closure of the gap between the capture roller and the web.

It is desirable that the backup roller be metallic such as steel, aluminum or a polymer of high hardness such as above 70 Shore A and that the transfer roller, the tackdown roller or the capture roller also be of durometer higher than 60 Shore A. Preferentially, the tackdown or capture roller should be above 80 Shore A. By making both rollers harder, it is possible to minimize the bump height to achieve the necessary gap between the web (or splice) and the roller to prevent toner transfer from the splice to the roller surface. In experiments, a gap of at least 0.005" (0.127 mm) was desirable across the splice. Preferentially, the gap across the splice should be higher than 0.010" (0.254 mm).

In experiments, the height of the bump providing a gap above 0.005" ranged from 0.014" to 0.085" (0.356 mm to 2.16 mm) depending on the hardness of the rollers tested and the normal loads and the span between the tape strips. The rollers tested ranged from 1" to 2" (2.54 cm to 5.08 cm) diameters having rubber or urethane blankets from 55 to 85 Shore A and normal loads from 2 to 12 lb. The tape strips or bumps were spaced by 10 to 13 inches (25.4 cm to 33.02 cm). The tape material was 3M polyester tape having a thickness of 0.002" to 0.003" (0.051 mm to 0.076 mm) and the final bump thickness was achieved by staggering sections of tapes on top of each other.

Figure 9:
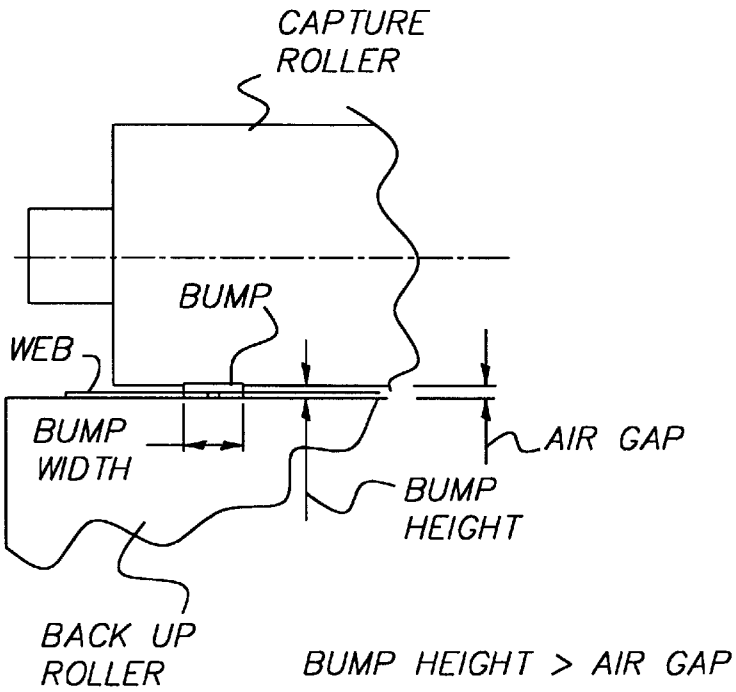
FIG. 9 illustrates an alternative elevational view of another bump configuration on a web seam.
Figure 7:
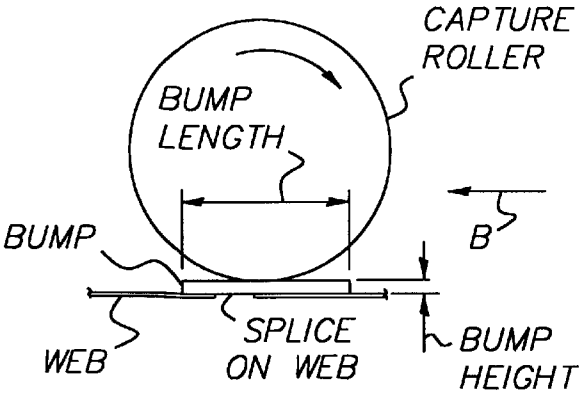
FIG. 7 is a side elevational view in schematic of a capture roller illustrating relationships of dimensions of a bump on the edge of a web.
Figure 8:
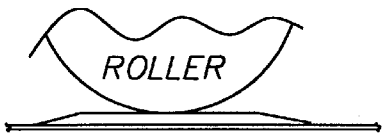
FIG. 8 is an elevational view of the apparatus of FIG. 7 and taken from a direction of view of arrow B in FIG. 7.

The recommended materials to use for the bump tape are polycarbonate, polyester, kapton, Mylar, polyethylene terephthalate (PET), Teflon tape, or any other material flexible to bending and high compressive strength (low deformation under compression). The tape will have an adhesive coating on the side facing the web which has a typical adhesion strength of 20 to 100 oz/in when tested with steel. The adhesive may be acrylic, silicone, rubber or other typical materials used in masking or Scotch tape applications. The bump tape length must be selected to lift the roller as it passes by the splice while allowing the roller to reengage with the web prior to touchdown with the next incoming sheet. The preferred length of the bump as shown in FIG. 7 is from 0.250" (0.635 cm) to 0.750" (1.90 cm). The bump tape width (see FIG. 8) should be a minimum of 0.100" (0.254 cm) and a maximum of 0.300" (0.762 cm) to avoid contact with the PC (or other PIFM) drum or IT drum or the web cleaners if blade cleaners are used. The placement of the bump is over the splice seam proximate or adjacent edges of the web and preferably inward thereof so that there is a substantial space along the seam between the two bumps that is uncovered where toner particles can collect in the seam. Preferably the PIFM, the ITM and a blade cleaner if one is used, will be narrower than the space between the bumps. Thus, at least one roller or blade will engage the surface of the web having the bumps but will be narrower than the space between the bumps whereas another roller will be wider than this space and raised over the seam when the web seam moves past this latter roller. Other possible bump configurations may be used including the one shown in FIG. 9. The roller cooperating with the bump so as to be tilted away from contact with the seam may be a transfer roller, a capture roller or a tackdown roller and the web may be a paper transport web or a photoconductor web. In lieu of a roller, a web may be substituted such as a transfer web or capture web as is known. The web is rotatable, i.e., moveable along a closed path.

The invention has been described in detail with particular reference to certain preferred embodiments thereof, but it will be understood that variations and modifications can be effected within the spirit and scope of the invention.

What is claimed is:

1. An image forming apparatus for transferring a toner image to a receiver sheet, the apparatus comprising:

an endless belt mounted for movement in a direction along a lengthwise direction of the belt and through an endless path, the belt including a splice seam that occurs in a direction transverse to the direction of movement of the belt and forming a discontinuity into which toner may tend to accumulate;

a rotatable member positioned to urge a receiving sheet into intimate contact with the belt; and a bump proximate each end of the splice seam and extending over the seam to support the rotatable member out of engagement with the splice seam to substantially preclude transfer to the rotatable member of toner accumulating in the splice seam in the space between the bumps as the rotatable member moves over the seam.

2. The apparatus of claim 1 wherein the rotatable member is a transfer member and engages the receiver sheet to transfer a toner image to the receiver sheet.

3. The apparatus of claim 2 wherein the height of each bump is sufficient to support the transfer member with a spacing between the belt and the transfer member of at least 0.005 inches.

4. The apparatus of claim 3 wherein the height of each bump is sufficient to support the transfer member with a spacing between the belt and the transfer member of at least 0.010 inches.

5. The apparatus of claim 1 wherein the height of the bump is sufficient to support the rotatable member with a gap spacing between the belt and the rotatable member of at least 0.005 inches.

6. The apparatus of claim 5 wherein the height of the bump is sufficient to support the rotatable member with a gap spacing between the belt and the rotatable member of at least 0.005 inches.

7. The apparatus of claim 1 wherein the rotatable member is a tackdown roller.

8. The apparatus of claim 1 wherein the rotatable member is a capture roller.

9. The apparatus of claim 1 and including control means for parking the rotatable member above the seam while resting upon the bumps.

10. The apparatus of claim 1 and including an additional member that engages the surface and operates thereon and the rotatable member has a greater length than the additional member so that the additional member does not contact the bumps as the belt moves.

11. The apparatus of claim 10 wherein a length of each bump is between 0.250 inches and 0.750 inches in the direction of movement of the belt and a width of each bump is between 0.100 inches and 0.300 inches.

12. The apparatus of claim 1 wherein the rotatable member engages a surface of the belt and wherein an additional member engages the surface and the rotatable member has a greater length than the additional member so that the additional member does not contact the bumps as the belt moves.

13. The apparatus of claim 12 wherein the additional member is selected from the group consisting of a primary image-forming member, an intermediate transfer member and a blade cleaner.

14. The apparatus of claim 13 wherein the rotatable member is selected from the group consisting of a capture roller, a tackdown roller and a transfer roller.

15. In a method for transferring a toner image to a receiver sheet, the method comprising:

moving an endless belt mounted for movement in a direction along a lengthwise dimension of the belt and through an endless path, the belt including a splice seam that occurs transverse to the direction of movement of the belt the seam having a discontinuity into which toner tends to collect which is free to transfer and the seam including a bump proximate each end of the splice seam and extending above the seam; and rotating a rotatable member while in engagement with a surface of the belt so as to urge a receiving sheet into intimate engagement with the surface between the rotatable member and the belt; and the bumps supporting the rotatable member out of engagement with the splice seam to substantially preclude transfer to the rotatable member of toner accumulating in the splice seam between the bumps.

16. The method of claim 15 and including parking the rotatable member above the seam while the rotatable member rests upon the bumps.

17. The method of claim 16 and including a backup roller that engages a surface of the belt that is opposite that engaged by the rotatable member and opposite the rotatable member and the rotatable member is more compliant than the backup roller.

18. The method of claim 15 and including a backup roller that engages a surface of the belt that is opposite that engaged by the rotatable member and opposite the rotatable member and the rotatable member is more compliant than the backup roller.

19. The method of claim 15 and including an additional member that engages the surface and operates thereon and the rotatable member has a greater length than the additional member so that the additional member does not contact the bumps as the belt moves.

20. The method of claim 19 wherein the additional member is selected from the group consisting of a primary image-forming member, an intermediate transfer member and a blade cleaner.

21. The method of claim 20 wherein the rotatable member is selected from the group consisting of a capture roller, a tackdown roller and a transfer roller.

22. The method of claim 21 and including parking the rotatable member above the seam while the rotatable member rests upon the bumps.

23. An endless belt suited for use in the method of claim 15, the belt including a splice seam providing a discontinuity that occurs transverse to a longitudinal direction of the belt and a bump formed proximate each end of the splice seam for supporting a rotatable member out of engagement with the splice scam.

24. The method of claim 15 and wherein the bumps are formed by a tape that overlies both the splice and a perforation in the belt to block arcing of web conditioning chargers.

25. The method of claim 15 wherein the height of each bump is sufficient to support the rotatable member with a gap spacing between the belt and the rotatable member of at least 0.005 inches.

26. The method of claim 15 and detecting the bumps to control a process of operation.

27. In a process for transferring a toner image, a method comprising:

moving a surface along an endless path, the surface including a discontinuity that occurs transverse to the direction of movement of the surface, the discontinuity tending to collect toner which is free to transfer;

providing a bump proximate each end of the discontinuity and above the discontinuity;

rotating a member while in engagement with the surface; and the bumps supporting the member out of engagement with the discontinuity to substantially preclude transfer to the member of toner collecting in the discontinuity between the bumps.

28. The method of claim 27 and including parking the member above the discontinuity while the member rests upon the bumps.

29. A surface suited for use in the method of claim 27, the surface including a toner collecting discontinuity that occurs transverse to a moving direction of the surface and a bump formed proximate each end of the discontinuity for supporting a member out of engagement with the discontinuity to preclude transfer to the member of toner collecting in the discontinuity.

* * * * *